United States Patent [19]

Plewes

[11] 4,142,918

[45] Mar. 6, 1979

[54] METHOD FOR MAKING FINE-GRAINED Cu-Ni-Sn ALLOYS

[75] Inventor: John T. Plewes, Berkeley Heights, N.J.

[73] Assignee: Bell Telephone Laboratories, Incorporated, Murray Hill, N.J.

[21] Appl. No.: 871,452

[22] Filed: Jan. 23, 1978

[51] Int. Cl.[2] ..... C22F 1/08

[52] U.S. Cl. ..... 148/11.5 C; 148/12.7 C; 148/160

[58] Field of Search ..... 148/11.5 C, 12.7 C, 148/160

[56] References Cited

U.S. PATENT DOCUMENTS

| | | | |
|---|---|---|---|
| 1,816,509 | 7/1931 | Wise | 75/154 |
| 4,012,240 | 3/1977 | Hinrichsen et al. | 148/11.5 C |

*Primary Examiner*—W. Stallard

*Attorney, Agent, or Firm*—Peter V. D. Wilde

[57] ABSTRACT

Cu-Ni-Sn alloys are of commercial interest in applications which involve shaping by mechanical working of an alloy as well as in casting applications. Disclosed is a method which is particularly beneficial for casting and forging applications, i.e. applications which involve only limited amounts of working or none at all. The disclosed method allows the production of a fine-grained structure in a Cu-Ni-Sn alloy by a thermal treatment which calls for maintaining the alloy at three specified distinct temperature levels for specified time periods. The resulting fine-grained alloy may undergo further processing as may be beneficial, e.g., to develop desired levels of strength and ductility.

16 Claims, No Drawings

METHOD FOR MAKING FINE-GRAINED CU-NI-SN ALLOYS

BACKGROUND OF THE INVENTION

1. Field of the Invention

The invention is concerned with copper-based alloys.

2. Description of the Prior Art

Recent developments in the preparation and processing of copper-rich Cu-Ni-Sn alloys have led to widespread interest in the application of such alloys for a variety of purposes. Among specific applications are the manufacture of electrical components such as wire, wire connectors, and relay elements as mentioned, e.g., in U.S. Pat. No. 3,937,638, "Method for Treating Copper-Nickel-Tin Alloy Compositions and Products Produced Therefrom," U.S. Pat. No. 4,052,204, "Quaternary Spinodal Copper Alloys," and allowed U.S. Pat. application Ser. No. 685,262, "Method for Making Copper-Nickel-Tin Strip Material" now U.S. Pat. No. 4,090,890. Such applications are largely based on alloy properties such as high strength and formability, good solderability, high electrical conductivity, and low electrical contact resistance.

Early investigations of the Cu-Ni-Sn alloy system such as those described by E. M. wise and J. T. Eash, "Strength and Aging Characteristics of the Nickel Bronzes," Trans. AIME, Institute of Metals Division, volume III, pages 218 - 243 (1934), by E. Fetz, "Uber aushartbare Bronzen auf Kupfer-Nickel-Zinn Basis," Zeitschrift fur Metallkunde, volume 28, pages 350 - 353 (1936), by T. E. Kihlgren, "Production and Properties of Age Hardenable Five Per Cent Nickel-Bronze Castings", Trans. AFA, volume 46, pages 41 - 64 (1938), and by A. M. Patton, "The Effect of Section Thickness on the Mechanical Properties of a Cast Age Hardenable Copper-Nickel-Tin Alloy," The British Foundryman, pages 129 - 135 (April 1962) were directed primarily to casting applications and yielded alloys having moderate strength and high hardness. More recent developments have led to Cu-Ni-Sn alloys having superior strength even in casting applications. For example, U.S. patent application Ser. No. 838,141 discloses Cu-Ni-Sn alloys which contain prescribed amounts of Nb, Ta, V, or Fe and which may be shaped as cast, e.g., in the manufacture of high-strength underwater telephone repeater housings.

It is generally appreciated that a uniformly fine grain structure such as induced, e.g., by hot working of an alloy is conducive to good fracture toughness in the alloy. It is similarly appreciated that such uniformly fine structure is desirable in castings and forgings, i.e. applications which may not involve uniform hot deformation of the alloy.

SUMMARY OF THE INVENTION

The invention is a method for treating Cu-Ni-Sn alloys so as to induce a uniformly fine structure as is beneficial, e.g., for the development of good fracture toughness. The method calls for a thermal treatment of the alloy and does not involve mechanical deformation. The thermal treatment comprises sequential steps which may be designated as partial homogenizing, discontinuous aging, and complete homogenizing, each step calling for maintaining the alloy at a prescribed temperature level for a prescribed time period. The method is particularly effective when the alloy, in addition to Cu, Ni, and Sn, contains specified small amounts of a fourth metal such as Mo, Nb, Ta, V, Zr, or Cr.

DETAILED DESCRIPTION

The new method for making fine-grained Cu-Ni-Sn alloys calls for a thermal treatment which may be conveniently described by reference to critical temperatures and time periods which are dependent on alloy composition. The method calls for maintaining an alloy at three temperature levels for specified periods of time. A first temperature level may be specified by reference to the so-called equilibrium boundary of an alloy, i.e. that temperature at which there is thermodynamic equilibrium between a homogeneous alpha single phase and a homogeneous alpha-plus-gamma double phase. A second, lower temperature may be specified by reference to a temperature variously known as the metastable boundary, coherent boundary, or reversion temperature of an alloy. This latter temperature may be characterized and experimentally determined in a number of ways as discussed, e.g., in "Spinodal Decomposition in a Cu — 9 wt % Ni — 6 wt % Sn Alloy" by L. H. Schwartz, S. Mahajan, and J. T. Plewes, Acta Metallurgica, volume 22, pages 601 - 609 (May 1974), "Spinodal Decomposition in Cu — 9 wt % Ni — 6 wt % Sn — II. A Critical Examination of Mechanical Strength of Spinodal Alloys" by L. H. Schwartz and J. T. Plewes, Acta Metallurgica, volume 22, pages 911 - 921 (July 1974), and "High - Strength Cu-Ni-Sn Alloys by Thermomechanical Processing" by J. T. Plewes, Metallurgical Transactions A, volume 6A, pages 537 - 544 (March 1975). In the present context, the metastable boundary of an alloy may be characterized as follows: While at temperatures below the equilibrium boundary but above the metastable boundary, a Cu-Ni-Sn alloy predominantly tends towards a homogeneous alpha-plus-gamma phase as mentioned above, at temperatures below the metastable boundary such alloy ultimately tends towards a discontinuous alpha-plus-gamma phase. Appreciable development of such discontinuous phase takes place after a certain incubation period which depends on alloy composition and temperature. A third, higher temperature may be specified by reference to the solidus of an alloy, i.e. the highest temperature at which the alloy is entirely in a solid state. Table 1, taken from the above-cited paper by J. T. Plewes, shows equilibrium boundary and metastable boundary values for a number of representative alloys.

Prior to application of the new thermal treatment a cast or forged body of a Cu-Ni-Sn alloy typically has a cored structure in which a coarse, irregular alpha-plus-gamma structure predominates. Grains typically have non-uniform composition and exhibit cells which are rich in Cu and Ni and which are interlaced with band- or ribbon-shaped islands which are rich in Sn. A first step of the new method for grain refining consists in maintaining such alloy at a first temperature which is in the vicinity of the equilibrium boundary of the alloy. Specifically, such first temperature should preferably be not more than 50° C. below the equilibrium boundary of the alloy and should preferably be not more than 50° C. above the equilibrium boundary.

It is a purpose of such first step to partially homogenize the alloy by a partial transfer of Sn from Sn-rich islands into Cu-Ni-rich cells. Complete homogenization is prevented, however, so as to retain Sn-rich islands which may subsequently act as nucleation regions for the discontinuous transformation. Time required for the realization of such partial homogenization is 4 to 6 hours when temperature is 50° C. below the equilibrium boundary and 0.5 to 1 hour when temperature is 50° C. above the equilibrium boundary of the alloy. Time limits and temperatures are related according to an Arrhenius relationship which permits determination of time limits corresponding to intermediate temperatures by linear interpolation of the logarithm of time as a function of temperature. In a more narrow preferred temperature range of 0 to 30° C. above the equilibrium boundary, preferred times are from 1 to 1.5 hours.

A second step of the method calls for rapidly cooling or, alternatively, quenching and reheating the alloy to a second temperature in the vicinity of the metastable boundary of the alloy. Such second temperature should preferably be not more than 75° C. below the metastable boundary of the alloy. Also, such second temperature should preferably be not more than 25° C. above the metastable boundary. It is required that the alloy be maintained at such second temperature for a time substantially longer than the incubation period of the discontinuous transformation. Accordingly, at a temperature 75° C. below the metastable boundary, such time should preferably be not less than 20 hours and, at a temperature 25° C. above the metastable boundary, not less than 1 hour. As stated above in the context of partial homogenization, time limits and temperatures are related according to an Arrhenius relationship which similarly permits the determination of time limits corresponding to intermediate temperatures. In a more narrow preferred temperature range of 50° C. below the metastable boundary to equal the metastable boundary, preferred lower time limits are from 5 hours to 1 hour. Longer times are particularly desirable in the treatment of bulky articles to ensure essentially uniform discontinuous transformation throughout the alloy.

In addition to being dependent on temperature, incubation time depends primarily on Sn content of the alloy, higher Sn content resulting in shorter incubation time. For example, alloys containing 7 to 15 weight percent Ni and 6 to 8 weight percent Sn, when aged for four hours at a temperature in the range of 475 to 525° C., exhibit substantial discontinuous transformation product. Alloys containing similar amounts of Ni, but 8 to 10 weight percent Sn, when aged for 3 hours at a temperature in the range of 450° to 500° C. also exhibit substantial discontinuous transformation product.

As a result of such second step, a non-coherent alpha-plus-gamma phase is discontinuously nucleated from Sn-rich islands, interfaces between phases expand, and interfaces eventually merge with each other to form new grain boundaries.

A third step of the method calls for maintaining the alloy at a third temperature which should preferably be in the range of 70° to 25° C. below the solidus of the alloy. A more narrow preferred range is 60° to 40° C. below such solidus. Such temperatures should preferably be maintained for at least one hour so as to effect essentially complete homogenization of the structure produced in the second step. Finally, the resulting homogenized fine-grained body is cooled. Such cooling, as well as cooling called for between the first and second steps of the method, is required to proceed at a rate sufficiently fast to retain a substantial amount of the structure developed in the preceding step of the method. While water quenching is adequate for this purpose, cooling may proceed at slower rates, minimal rate required being dependent on alloy composition. In general, for alloys having a fixed Ni content, minimal rate increases with decreasing Sn content. Conversely, for alloys having a fixed Sn content, minimal rate increases with increasing Ni content. For example, an alloy containing 9 percent Ni, 8 percent Sn, and remainder copper requires that the transition from the first temperature to the second temperature take no more than approximately 30 seconds. On the other hand, this transition may take as long as 10 minutes in an alloy which contains 9 percent Ni, 6 percent Sn, and remainder copper. The addition of fourth elements to the alloy also tends to decrease minimal required cooling rate except that the addition of Fe tends to call for faster cooling rates. Minimal rate for any specific alloy composition may be determined from an isoresistivity plot as discussed in the paper by L. H. Schwartz, S. Mahajan, and J. T. Plewes cited above.

The thermal treatment described above may be applied to a metallic body which is shaped as cast, as warm worked as described in U.S. Pat. No. 4,012,240, "Cu-Ni-Sn- Alloy Processing," or as hot worked such as by forging or extruding. The treatment is considered to be particularly beneficial when applied to castings and forgings, i.e. articles which, due to their shape or bulk, are less amenable to be subjected to uniform hot or warm deformation. The treatment is particularly beneficial also when applied to articles which may undergo only limited amounts of cold work such as, e.g., not exceeding 15 percent area reduction. An alloy as processed by the disclosed grain refining method may undergo further processing such as by spinodal aging, cold working followed by spinodal aging, or duplexed cold working and spinodal aging as may be feasible and desirable depending on the application.

The disclosed method may be beneficially applied to copper-rich Cu-Ni-Sn alloys and, more specifically, to alloys in which an aggregate amount of at least 90 weight percent consists of Cu, Ni, and Sn, Ni content of such aggregate amount being in the range of 5 - 30 weight percent and Sn content in the range of 4 - 12 weight percent. The remaining at most 10 weight percent of the alloy may be diluents such as Fe, Mn, and Zn whose presence, however, tends to lengthen the incubation time of the discontinuous transformation and, consequently, to call for prolonged aging times in the second step of the method. Preferred upper limits on individual diluent elements are 7 weight percent Fe, 5 weight percent Mn, and 10 weight percent Zn. Preferred upper limits on the presence of impurities such as may be present in commercially available materials are as follows: 0.2 weight percent Co, 0.1 weight percent Al, 0.01 weight percent P, and 0.05 weight percent Si. Additives such as Se, Te, Pb, and MnS disclosed in pending application of J. T. Plewes and P. R. White, Ser. No. 866,023, filed Dec. 30, 1977, and now U.S. Pat. No. 4,130,421, for enhancing machinability of the alloy do not interfere with the grain refining treatment disclosed in the present application and may be present in the alloy in amounts up to 0.5 weight percent Se, 0.5 weight percent Te, 0.2 weight percent Pb, and two weight percent MnS. The presence of small amounts of fourth elements such as Mo, Nb, Ta, V, Zr, and Cr, is recommended to enhance the effectiveness of the new method. Such refractory elements are beneficial in preferred amounts of 0.02–0.1 weight percent Mo, 0.05–0.35 weight percent Nb, 0.02–0.3 weight percent Ta, 0.1–0.5 weight percent V, 0.02–0.2 weight percent Zr, and 0.05–0.5 weight percent Cr. In the presence of such fourth metals, discontinuous aging is preferably carried out for an extended period of time. In particular, at temperatures of +25, 0, −50, and −75° C. relative to the metastable boundary, preferred lower limits on aging time are 2, 3, 6, and 27 hours repsectively.

In the presence of refractory metals, oxygen content of the alloy should preferably be kept below 100 ppm to minimize the formation of refractory metal oxides.

EXAMPLE 1

An ingot of a Cu-Ni-Sn alloy containing 15 weight percent Ni and 8 weight percent Sn which was cast into a split steel mold at a temperature 100° C. above the liquidus, was observed to have 0.25-inch average grain size. The ingot was heated to a first temperature of 825° C. and maintained at such first temperature for 1 hour. The ingot was water quenched and reheated to a second temperature of 500° C. and maintained at such second temperature for 17 hours. Finally, the ingot was reheated to a third temperature of 900° C., maintained at such third temperature for 1 hour, and quenched to room temperature. A 0.003-inch average grain size was observed in the treated ingot.

EXAMPLE 2

Case ingots containing 15 weight percent Ni, 8 weight percent Sn, 0.2 weight percent Nb, and remainder copper were treated by procedures which did and which did not encompass the new grain refinement technique. Specifically, treatment encompassing the new technique was by extruding a cast ingot, homogenizing, grain refining, and aging. Treatment not encompassing the new technique was by extruding, homogenizing, and aging. In both cases, final aging was performed in several different amounts so as to produce different combinations of ultimate strength and fracture toughness. Table II shows fracture toughness as measured by elongation to fracture corresponding to levels of strength as measured by 0.01 percent yield limit. It can be seen from Table II that, as a result of grain refining, superior fracture toughness is obtained corresponding to specific levels of strength.

TABLE I

| Alloy | Equilibrium Boundary, ° C. | Metastable Boundary, ° C. |
|---|---|---|
| Cu-3.5Ni-2.5Sn | 617 | 360 |
| Cu-5Ni-5Sn | 692 | 410 |
| Cu-7Ni-8Sn | 770 | 450 |
| Cu-9Ni-6Sn | 740 | 464 |
| Cu-10.5Ni-4.5Sn | 751 | 450 |
| Cu-12Ni-8Sn | 816 | 490 |
| Cu-14Ni-6Sn | 780 | 480 |

TABLE II

| Yield Limit, Kpsi | Fracture Elongation, % | |
|---|---|---|
| | Without Grain Refinement | With Grain Refinement |
| 90 | 4 | 14 |
| 100 | 1 | 9 |
| 110 | 0.2 | 6 |

What is claimed is :

1. Method for producing an article of manufacture comprising a fine-grained body of an alloy comprising the steps, carried out in the order stated, of (1) partially homogenizing a body of the alloy of which an aggregate amount of at least 90 weight percent consists of Cu, Ni, and Sn, said aggregate amount having a Ni content in the range of 5 to 30 weight percent and a Sn content in the range of 4 to 12 weight percent by maintaining said body at a first temperature which is in a first temperature range of 50° C. below to 50° C. above the equilibrium boundary between an alpha phase and an alpha-plus-gamma phase of said alloy for a first time which is in a first time range having a first lower time limit and a first upper time limit, said first lower time limit and said first upper time limit being related to said temperature according to Arrhenius relationships, said first lower time limit being 4 hours and said first upper time limit being 6 hours when said first temperature is 50° C. below said equilibrium boundary, and said first lower time limit being 0.5 hours and said first upper time limit being 1 hour when said first temperature is 50° C. above said equilibrium boundary, (2) cooling said body at a rate sufficiently fast to retain in said alloy a substantial amount of the structure developed by partially homogenizing said body and maintaining said alloy at a second temperature which is in a second temperature range of 75° C. below to 25° C. above the metastable boundary of said alloy, said metastable boundary being CHARACTERIZED IN THAT at temperatures above said metastable boundary but below said equilibrium boundary said alpha-plus-gamma phase is nucleated homogeneously while at temperatures below said metastable boundary said alpha-plus-gamma phase is nucleated discontinuously, aging being carried out for a second time which is equal to or greater than a second lower time limit, said second lower time limit being related to said second temperature according to an Arrhenius relationship, said second lower time limit being 20 hours when said second temperature is 75° C. below said metastable boundary and said second lower time limit being 1 hour when said second temperature is 25° C. above said metastable boundary, (3) completely homogenizing said body by maintaining said alloy at a third temperature which is in a third temperature range of 70° to 25° C. below the solidus of said alloy for a third time which is equal to or greater than 1 hour, and (4) cooling said alloy at a rate sufficiently fast to retain a substantial amount of the structure developed by completely homogenizing said body.

2. Method of claim 1 in which the lower limit of said first temperature range is equal to said equilibrium boundary, in which the upper limit of said first temperature range is 30° C. above said equilibrium boundary, in which said first lower time limit is 1 hour, and in which said first upper time limit is 1.5 hours.

3. Method of claim 1 in which the lower limit of said second temperature range is 50° C. below said metastable boundary, in which the upper limit of said second temperature is equal to said metastable boundary, in which said second lower time limit is 5 hours when said second temperature is 50° C. below said metastable boundary, and in which said second lower time limit is 1 hour when said second temperature is equal to said metastable boundary.

4. Method of claim 1 in which said third temperature is in the range of 60° to 40° C. below the solidus of said alloy.

5. Method of claim 1 in which said body is a casting, a forging, or an extrusion.

6. Method of claim 1 in which said body, subsequently to cooling, is deformed by an amount of less than 15 percent area reduction.

7. Method of claim 1 in which said aggregate amount has a Ni content in the range of 7 to 15 weight percent.

8. Method of claim 7 in which said aggregate amount has a Sn content in the range of 6 to 8 weight percent and in which said second temperature is in the range of 475° to 525° C.

9. Method of claim 7 in which said aggregate amount has a Sn content in the range of 8 to 10 weight percent and in which said second temperature is in the range of 450° to 500° C.

10. Method of claim 1 in which said body, subsequent to cooling, is subjected to spinodal aging.

11. Method of claim 1 in which said body, subsequent to cooling, is subjected to cold working and spinodal aging.

12. Method of claim 11 in which cold working and spinodal aging are carried out in duplexed fashion.

13. Method of claim 1 in which said alloy contains at least one diluent selected from the group consisting of not more than 7 weight percent Fe, not more than 5 weight percent Mn, and not more than 10 weight percent Zn.

14. Method of claim 1 in which said alloy contains not more than 0.2 weight percent Co, not more than 0.1 weight percent Al, not more than 0.01 weight percent P, and not more than 0.05 weight percent Si.

15. Method of claim 1 in which said alloy contains at least one freemachining additive selected from the group consisting of not more than 0.5 weight percent Se, not more than 0.5 weight percent Te, not more than 0.2 weight percent Pb, and not more than 2 weight percent MnS.

16. Method of claim 1 in which said body contains at least one fourth metal additive selected from the group consisting of Mo in the range of 0.02–0.1 weight percent, Nb in the range of 0.05–0.35 weight percent, Ta in the range of 0.02–0.3 weight percent, V in the range of 0.1–0.5 weight percent, Zr in the range of 0.02–0.2 weight percent, and Cr in the range of 0.05–1.0 weight percent.

* * * * *